US011952181B2

(12) United States Patent
Holley, Jr.

(10) Patent No.: US 11,952,181 B2
(45) Date of Patent: Apr. 9, 2024

(54) CARTON FOR FOOD PRODUCTS

(71) Applicant: Graphic Packaging International, LLC, Atlanta, GA (US)

(72) Inventor: John Murdick Holley, Jr., Lawrenceville, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 17/519,080

(22) Filed: Nov. 4, 2021

(65) Prior Publication Data

US 2022/0144479 A1 May 12, 2022

Related U.S. Application Data

(60) Provisional application No. 63/191,412, filed on May 21, 2021, provisional application No. 63/178,116,
(Continued)

(51) Int. Cl.

| | |
|---|---|
| ***B65D 5/28*** | (2006.01) |
| ***B65D 5/20*** | (2006.01) |
| ***B65D 5/24*** | (2006.01) |
| ***B65D 5/42*** | (2006.01) |
| ***B65D 5/44*** | (2006.01) |

(Continued)

(52) U.S. Cl.

CPC ..... *B65D 5/4295* (2013.01); *B65D 5/2047* (2013.01); *B65D 5/248* (2013.01); *B65D 5/4266* (2013.01); *B65D 5/4279* (2013.01); *B65D 5/443* (2013.01); *B65D 21/0233* (2013.01); *B65D 85/50* (2013.01); *B65D 5/28* (2013.01)

(58) Field of Classification Search

CPC ..... B65D 5/029; B65D 5/28; B65D 5/209; B65D 5/2047; B65D 5/243; B65D 5/246

USPC .. 229/125.35, 165, 169–172, 182, 190, 198, 229/164, 918, 109, 110; 206/557

See application file for complete search history.

(56) References Cited

U.S. PATENT DOCUMENTS

| | | | |
|---|---|---|---|
| 622,921 | A | 4/1899 | Fuller |
| 667,634 | A | 2/1901 | Schmidt |

(Continued)

FOREIGN PATENT DOCUMENTS

| | | |
|---|---|---|
| DE | 1810600 A1 | 7/1969 |
| EP | 0 270 838 | 6/1988 |

(Continued)

OTHER PUBLICATIONS

International Search Report and Written Opinion for PCT/US2021/058048 dated Feb. 18, 2022.

(Continued)

*Primary Examiner* — Christopher R Demeree
*Assistant Examiner* — Phillip D Schmidt
(74) *Attorney, Agent, or Firm* — Womble Bond Dickinson (US) LLP

(57) ABSTRACT

A tray for holding at least one food product includes a plurality of panels extending at least partially around an interior of the tray, the plurality of panels including a bottom panel, a front panel, a back panel, and at least one side panel, and a plurality of end flaps including a plurality of top end flaps cooperating to form a rim extending from the plurality of panels, each top end flap of the plurality of top end flaps foldably connected to an adjacent top end flap of the plurality of top end flaps.

31 Claims, 5 Drawing Sheets

Related U.S. Application Data filed on Apr. 22, 2021, provisional application No. 63/174,724, filed on Apr. 14, 2021, provisional application No. 63/169,418, filed on Apr. 1, 2021, provisional application No. 63/169,302, filed on Apr. 1, 2021, provisional application No. 63/139,341, filed on Jan. 20, 2021, provisional application No. 63/128,418, filed on Dec. 21, 2020, provisional application No. 63/126,157, filed on Dec. 16, 2020, provisional application No. 63/110,587, filed on Nov. 6, 2020, provisional application No. 63/110,578, filed on Nov. 6, 2020, provisional application No. 63/110,582, filed on Nov. 6, 2020.

(51) Int. Cl.
*B65D 21/02* (2006.01)
*B65D 85/50* (2006.01)

(56) References Cited

U.S. PATENT DOCUMENTS 1,683,761 A 9/1928 Craig
1,894,209 A 1/1933 Wikstrom
1,999,461 A * 4/1935 Kells ..... B65D 5/46048 229/125.32
2,016,754 A 10/1935 Perkit
2,028,276 A 1/1936 Evans
2,037,502 A 4/1936 Cox
2,043,104 A 6/1936 Clancy
2,163,017 A 6/1939 Berch
2,232,088 A 2/1941 Waters
2,279,670 A * 4/1942 Ford ..... B65D 5/28 229/176
2,321,848 A 6/1943 O'Reilly
2,740,576 A 4/1956 Franck
2,800,893 A 7/1957 Norman et al.
2,836,339 A 5/1958 Pringle
2,858,630 A 11/1958 Gorman
2,859,905 A 11/1958 Choate
2,944,721 A 7/1960 Choate
3,102,674 A 9/1963 Portola
3,116,866 A 1/1964 Frank
3,246,830 A 4/1966 Smith
3,276,660 A 10/1966 Vesak
3,300,117 A 1/1967 Kossnar
3,316,102 A * 4/1967 Doll ..... B65D 77/2024 229/116
3,355,085 A 11/1967 Olaf
3,366,306 A 1/1968 Kotowick
3,425,543 A 2/1969 Harvey
3,447,672 A 6/1969 Bailey et al.
3,478,950 A 11/1969 Stevens
3,515,331 A 6/1970 Guthrie, Sr.
3,516,594 A 6/1970 Stenzel
3,516,595 A 6/1970 Bailey
3,536,248 A 10/1970 Eriksson
3,550,835 A 12/1970 Persson
3,559,869 A 2/1971 Reynolds
3,606,078 A 9/1971 Phillips, Jr.
3,630,430 A 12/1971 Struble
3,637,130 A 1/1972 Farquhar
3,701,467 A 10/1972 Johansson
3,715,853 A 2/1973 Bemiss
3,739,939 A 6/1973 Koenig
3,767,108 A 10/1973 Arneson
3,833,113 A 9/1974 Osier
3,845,897 A 11/1974 Buttery et al.
3,863,832 A 2/1975 Gordon
3,876,131 A 4/1975 Tolaas
3,877,632 A 4/1975 Steel
3,912,331 A 10/1975 Turner et al.
3,917,155 A 11/1975 Bemiss
3,927,823 A 12/1975 Persson
4,014,496 A 3/1977 Christensson
4,034,907 A * 7/1977 Engdahl, Jr. ..... B65D 5/2047 53/49
4,049,188 A 9/1977 Persson
4,054,241 A 10/1977 Meyers et al.
4,079,853 A 3/1978 Casutt
4,109,848 A 8/1978 Kipp et al.
4,114,797 A 9/1978 Manizza
4,124,160 A 11/1978 Meyers et al.
4,126,265 A 11/1978 Holmes
4,130,236 A 12/1978 Manizza
4,166,567 A 9/1979 Beach, Jr. et al.
4,185,764 A 1/1980 Cote
4,199,097 A 4/1980 Christensson
4,205,775 A 6/1980 Swan
4,227,640 A 10/1980 Roccaforte
4,244,472 A 1/1981 Brown
4,267,955 A 5/1981 Struble
4,277,506 A 7/1981 Austin
4,283,427 A 8/1981 Winters et al.
4,305,543 A 12/1981 Lai
4,308,985 A 1/1982 Manizza
4,362,266 A 12/1982 Webinger
4,410,129 A 10/1983 Wischusen, III
4,417,882 A 11/1983 Wallin
4,418,861 A 12/1983 McFarland et al.
4,432,489 A 2/1984 Cote
4,502,623 A 3/1985 Moore et al.
4,607,785 A 8/1986 Croley
4,648,549 A 3/1987 Trutna
4,676,429 A 6/1987 Crowe et al.
D290,813 S 7/1987 Forbes, Jr.
4,682,727 A 7/1987 Stoll
4,718,596 A 1/1988 Muller
4,765,534 A 8/1988 Zion et al.
4,775,771 A 10/1988 Pawlowski et al.
4,792,084 A 12/1988 Dreeszen
4,801,774 A 1/1989 Hart
4,836,439 A 6/1989 Hart
4,846,398 A 7/1989 Johnson
4,865,921 A 9/1989 Hollenberg et al.
4,871,111 A 10/1989 Mode
4,890,439 A 1/1990 Smart
4,901,911 A * 2/1990 Drexhage ..... B65D 5/2047 229/160
4,905,834 A 3/1990 Mur Gimeno et al.
4,915,235 A 4/1990 Roosa
4,919,267 A 4/1990 Stoll
4,936,935 A 6/1990 Beckett
4,943,456 A 7/1990 Pollart et al.
4,955,530 A 9/1990 Rigby
4,963,424 A 10/1990 Beckett
4,998,669 A 3/1991 Karolyi
5,002,826 A 3/1991 Pollart et al.
5,039,364 A 8/1991 Beckett et al.
5,049,710 A 9/1991 Prosise et al.
5,077,455 A 12/1991 Peleg et al.
5,117,078 A 5/1992 Beckett
5,118,747 A 6/1992 Pollart et al.
5,211,330 A 5/1993 Frey
5,213,902 A 5/1993 Beckett
5,221,419 A 6/1993 Beckett
5,232,149 A 8/1993 Stoll
5,247,149 A 9/1993 Peleg
5,260,537 A 11/1993 Beckett
5,266,386 A 11/1993 Beckett
5,294,765 A 3/1994 Archibald et al.
5,326,021 A 7/1994 Farrell
RE34,683 E 8/1994 Maynard et al.
5,338,921 A 8/1994 Maheux et al.
5,340,436 A 8/1994 Beckett
5,351,879 A 10/1994 Liu et al.
5,354,973 A 10/1994 Beckett
5,410,135 A 4/1995 Pollart et al.
5,412,187 A 5/1995 Walters et al.
5,424,517 A 6/1995 Habeger, Jr. et al.
5,433,374 A 7/1995 Forbes, Jr.
5,519,195 A 5/1996 Keefer et al.
5,520,322 A 5/1996 Conviser

(56) References Cited

U.S. PATENT DOCUMENTS 5,530,231 A 6/1996 Walters et al.
5,535,942 A 7/1996 Vilona
5,628,921 A 5/1997 Beckett
5,672,407 A 9/1997 Beckett
5,718,368 A 2/1998 Rench et al.
5,720,429 A 2/1998 Cordle
5,726,426 A 3/1998 Davis et al.
5,759,422 A 6/1998 Schmelzer et al.
5,762,225 A 6/1998 Byrd
5,800,724 A 9/1998 Habeger et al.
5,816,485 A 10/1998 Bernstein
5,948,308 A 9/1999 Wischusen, III
5,961,035 A 10/1999 Correll
6,019,276 A 2/2000 Auclair
6,050,482 A 4/2000 Cai
6,050,483 A 4/2000 Haraldsson
6,092,720 A * 7/2000 Karolyi ..... B65D 5/2047 229/169
6,102,281 A 8/2000 Lafferty et al.
6,114,679 A 9/2000 Lai et al.
6,137,099 A 10/2000 Hamblin
6,150,646 A 11/2000 Lai et al.
6,170,740 B1 1/2001 Clark
D437,557 S 2/2001 Ingelin et al.
6,182,890 B1 2/2001 Sattler et al.
6,204,492 B1 3/2001 Zeng et al.
6,251,451 B1 6/2001 Zeng
6,273,610 B1 8/2001 Koyama
6,359,272 B1 3/2002 Sadek et al.
6,371,363 B1 4/2002 Franklin et al.
6,371,364 B1 4/2002 Maillot
6,393,761 B1 5/2002 Deacon
6,414,290 B1 7/2002 Cole et al.
6,433,322 B2 8/2002 Zeng et al.
6,455,827 B2 9/2002 Zeng
6,513,704 B1 2/2003 Perot
6,552,315 B2 4/2003 Zeng et al.
6,561,414 B1 5/2003 Cai
6,588,652 B2 7/2003 Cai
6,677,563 B2 1/2004 Lai
6,717,121 B2 4/2004 Zeng et al.
6,719,190 B2 4/2004 Yocum
6,765,182 B2 7/2004 Cole et al.
6,808,105 B2 10/2004 Lee
7,007,838 B1 3/2006 Bostick, II
7,017,797 B2 3/2006 Goglio
7,019,271 B2 3/2006 Wnek et al.
7,140,532 B2 11/2006 Holt et al.
7,219,828 B2 5/2007 Lombardo
7,232,055 B1 6/2007 Lim
7,273,162 B2 9/2007 Baker
7,323,669 B2 1/2008 Robison et al.
7,328,833 B1 2/2008 Wiley
D563,155 S 3/2008 Wyllie
D567,592 S 4/2008 Fite, IV
7,351,942 B2 4/2008 Wnek et al.
7,365,292 B2 4/2008 Cole et al.
7,473,875 B2 1/2009 Fitzwater
7,514,659 B2 4/2009 Lafferty
7,541,562 B2 6/2009 Cole et al.
D600,550 S 9/2009 King
D603,255 S 11/2009 King
D603,256 S 11/2009 King
7,648,031 B2 1/2010 Kari
7,648,059 B2 1/2010 Pavlu, Jr. et al.
7,667,167 B2 2/2010 Fitzwater
7,743,971 B2 6/2010 DeVine
7,748,536 B2 7/2010 Cassese et al.
7,762,394 B2 7/2010 Bradford et al.
D622,589 S 8/2010 Elias
7,793,821 B2 9/2010 Oliveira
7,798,327 B1 9/2010 Berkani et al.
7,824,719 B2 11/2010 Cole et al.
7,870,995 B1 1/2011 Kaltman
7,893,389 B2 2/2011 Fitzwater
7,959,061 B2 6/2011 Kaltman
7,975,871 B2 7/2011 Wnek et al.
7,982,167 B2 7/2011 Fitzwater
7,982,349 B2 7/2011 Popov et al.
8,013,280 B2 9/2011 Robison et al.
8,063,344 B2 11/2011 Cole et al.
D650,667 S 12/2011 Osentoski
8,087,570 B2 1/2012 Ho Fung
8,106,339 B2 1/2012 Robbins et al.
8,158,914 B2 4/2012 Wnek et al.
8,183,506 B2 5/2012 Fitzwater
8,186,570 B2 5/2012 Learn
8,252,217 B2 8/2012 Wnek et al.
8,309,896 B2 11/2012 Fitzwater
D677,154 S 3/2013 Miller
8,492,690 B1 7/2013 Watkins
8,534,536 B2 9/2013 Mueller et al.
8,567,661 B2 10/2013 Sullivan
D699,447 S 2/2014 Pirayesh
D719,019 S 12/2014 Avis
9,027,825 B2 5/2015 Baker
9,078,296 B2 7/2015 Fitzwater
9,113,648 B2 8/2015 Burke
9,402,491 B1 8/2016 Debernardi
D775,947 S 1/2017 Epstein
9,676,511 B2 6/2017 Kaltman
10,232,973 B2 3/2019 Burke
10,336,500 B2 7/2019 Burke
D931,725 S 9/2021 Rana
D942,267 S 2/2022 Rana
11,247,799 B2 2/2022 Arnold
11,345,508 B2 5/2022 Wisecarver
11,370,576 B1 * 6/2022 Bevier ..... B65D 5/4266
11,794,943 B2 10/2023 Sanchez
2001/0032843 A1 10/2001 Aronsson et al.
2002/0084319 A1 7/2002 Yocum
2003/0006273 A1 1/2003 Tsern et al.
2003/0102363 A1 6/2003 Chang
2003/0197053 A1 10/2003 Haraldsson
2003/0226881 A1 12/2003 Liou
2004/0232034 A1 11/2004 Lebras
2004/0234653 A1 11/2004 Cogley et al.
2004/0238534 A1 12/2004 Mast
2005/0082355 A1 4/2005 Beutler
2005/0184066 A1 8/2005 Brooks et al.
2005/0194286 A1 9/2005 Ilyayeva et al.
2005/0205565 A1 9/2005 Cole et al.
2006/0006215 A1 * 1/2006 Chen ..... B65D 5/563 229/109
2006/0049190 A1 3/2006 Middleton et al.
2006/0096978 A1 5/2006 Lafferty et al.
2006/0113300 A1 6/2006 Wnek et al.
2006/0180644 A1 8/2006 Baker
2006/0278521 A1 12/2006 Stowell
2007/0056962 A1 3/2007 Hopkins, Sr. et al.
2007/0102424 A1 5/2007 Keefe
2007/0131744 A1 6/2007 Fitzwater
2007/0131745 A1 6/2007 Fitzwater
2007/0215611 A1 9/2007 O'Hagan et al.
2007/0251942 A1 11/2007 Cole et al.
2007/0251943 A1 11/2007 Wnek et al.
2007/0262487 A1 11/2007 O'Hagan et al.
2007/0275130 A1 11/2007 Cole et al.
2008/0000897 A1 1/2008 Robbins et al.
2008/0023469 A1 1/2008 Fitzwater
2008/0035634 A1 2/2008 Zeng et al.
2008/0047958 A1 2/2008 Cole et al.
2008/0078759 A1 4/2008 Wnek et al.
2008/0081095 A1 4/2008 Cole et al.
2008/0110966 A1 5/2008 Yocum
2009/0072015 A1 3/2009 Drew et al.
2009/0090708 A1 4/2009 Requena et al.
2009/0218338 A1 9/2009 Futzwater
2010/0025393 A1 2/2010 Talpaert
2010/0038359 A1 2/2010 Laubhan et al.
2010/0051675 A1 3/2010 Sweet
2010/0065556 A1 3/2010 Cole
2010/0065621 A1 3/2010 Quaintance
2010/0072197 A1 3/2010 Neff et al.

(56) References Cited

U.S. PATENT DOCUMENTS

| | | | |
|---|---|---|---|
| 2010/0102111 | A1 | 4/2010 | Learn |
| 2010/0122999 | A1 | 5/2010 | Brand |
| 2010/0193509 | A1 | 8/2010 | Fitzwater |
| 2010/0264135 | A1 | 10/2010 | Cole |
| 2011/0024413 | A1 | 2/2011 | Cole |
| 2011/0089227 | A1 | 4/2011 | Kaltman et al. |
| 2011/0114715 | A1 | 5/2011 | House |
| 2011/0132903 | A1 | 6/2011 | Cole |
| 2011/0233266 | A1 | 9/2011 | Pezzoli |
| 2012/0228370 | A1 | 9/2012 | Faulon et al. |
| 2013/0087607 | A1 | 4/2013 | Learn |
| 2013/0299566 | A1 | 11/2013 | Sylvester |
| 2014/0374953 | A1 | 12/2014 | Middleton |
| 2015/0375468 | A1 | 12/2015 | Wnek |
| 2016/0096648 | A1 | 4/2016 | Pinkstone |
| 2016/0360912 | A1 | 12/2016 | Chang |
| 2021/0053714 | A1 | 2/2021 | Zwaga |
| 2022/0048672 | A1 | 2/2022 | Bevier |

FOREIGN PATENT DOCUMENTS

| | | | | | |
|---|---|---|---|---|---|
| EP | 0 270 551 | B1 | | 7/1990 | |
| EP | 0 392 227 | B1 | | 2/1993 | |
| EP | 1 481 922 | | | 12/2004 | |
| EP | 1 364 558 | | | 3/2005 | |
| EP | 2 240 385 | | | 6/2008 | |
| EP | 2 605 974 | | | 3/2014 | |
| EP | 2 974 973 | | | 1/2016 | |
| FR | 2 867 346 | | | 9/2005 | |
| GB | 2042474 | A | * | 9/1980 | ..... B65D 5/003 |
| GB | 2137170 | A | * | 10/1984 | ..... B65D 5/003 |
| GB | 2 234 958 | A | | 2/1991 | |
| GB | 2479703 | A | * | 10/2011 | ..... B65D 5/243 |
| JP | 53-161938 | U | | 12/1978 | |
| JP | 4-253670 | | | 9/1992 | |
| JP | 6-293334 | | | 10/1994 | |
| JP | 7-040968 | | | 2/1995 | |
| JP | 2000-255546 | A | | 9/2000 | |
| JP | 2001-247122 | | | 2/2001 | |
| JP | 2001-080628 | A | | 3/2001 | |
| JP | 2011-006071 | | | 1/2011 | |
| JP | 2018-047939 | A | | 3/2018 | |
| KR | 20-0184133 | Y1 | | 6/2000 | |
| KR | 10-1363935 | | | 2/2014 | |
| KR | 10-1494078 | B1 | | 2/2015 | |
| KR | 10-2019-0053053 | A | | 5/2019 | |
| WO | WO 94/05563 | | | 3/1994 | |
| WO | WO 02/060223 | | | 8/2002 | |
| WO | WO 03/066435 | | | 8/2003 | |
| WO | WO 2005/077783 | | | 8/2005 | |
| WO | WO 2006/076501 | | | 7/2006 | |
| WO | WO 2007/127235 | | | 11/2007 | |
| WO | WO 2007/127371 | | | 11/2007 | |
| WO | WO 2007/133659 | | | 11/2007 | |
| WO | WO 2007/136839 | | | 11/2007 | |
| WO | WO 2009/006096 | | | 1/2009 | |
| WO | WO 2012/024206 | | | 2/2012 | |
| WO | WO 2019/092323 | A1 | | 5/2019 | |
| WO | WO 2019/179930 | A1 | | 9/2019 | |

OTHER PUBLICATIONS

International Search Report and Written Opinion for PCT/US2021/058050 dated Feb. 22, 2022.
International Search Report and Written Opinion for PCT/US2021/058051 dated Feb. 17, 2022.
U.S. Appl. No. 29/785,893, filed May 27, 2021.
U.S. Appl. No. 17/519,084, filed Nov. 4, 2021.
U.S. Appl. No. 29/785,899, filed May 27, 2021.
U.S. Appl. No. 17/519,092, filed Nov. 4, 2021.
U.S. Appl. No. 29/785,900, filed May 27, 2021.
U.S. Appl. No. 17/519,097, filed Nov. 4, 2021.
U.S. Appl. No. 29/785,905, filed May 27, 2021.
U.S. Appl. No. 17/519,107, filed Nov. 4, 2021.
U.S. Appl. No. 29/785,902, filed May 27, 2021.
U.S. Appl. No. 29/785,897, filed May 27, 2021.
U.S. Appl. No. 29/785,904, filed May 27, 2021.
U.S. Appl. No. 29/785,895, filed May 27, 2021.
U.S. Appl. No. 29/785,896, filed May 27, 2021.
International Search Report and Written Opinion for PCT/US2021/058049 dated Feb. 22, 2022.
International Search Report and Written Opinion for PCT/US2021/058043 dated Feb. 18, 2022.
Produce Packaging: Announced [Date Not Available; online]. Retrieved [Nov. 2, 2023]. URL: https://bmxlovesk.xyz/product_details/ 12338874.html (Year: 2023).
Start Packaging: Announced [Date Not Available; online]. Retrieved [Nov. 2, 2023]. URL: https://www.goodstartpackaging.com/2- quart-reversible-paper-produce-containers-sample/ (Year: 2023).

* cited by examiner

CARTON FOR FOOD PRODUCTS

CROSS-REFERENCE TO RELATED APPLICATIONS

The present application claims the benefit of each of U.S. Provisional Patent Application No. 63/110,578, filed on Nov. 6, 2020, U.S. Provisional Patent Application No. 63/110,582, filed on Nov. 6, 2020, U.S. Provisional Patent Application No. 63/110,587, filed on Nov. 6, 2020, U.S. Provisional Patent Application No. 63/126,157, filed on Dec. 16, 2020, U.S. Provisional Patent Application No. 63/128,418, filed on Dec. 21, 2020, U.S. Provisional Patent Application No. 63/139,341, filed on Jan. 20, 2021, U.S. Provisional Patent Application No. 63/169,302, filed on Apr. 1, 2021, U.S. Provisional Patent Application No. 63/169,418, filed on Apr. 1, 2021, U.S. Provisional Patent Application No. 63/174,724, filed on Apr. 14, 2021, U.S. Provisional Patent Application No. 63/178,116, filed on Apr. 22, 2021, and U.S. Provisional Patent Application No. 63/191,412, filed on May 21, 2021.

INCORPORATION BY REFERENCE

The disclosures of each of U.S. Provisional Patent Application No. 63/110,578, filed on Nov. 6, 2020, U.S. Provisional Patent Application No. 63/110,582, filed on Nov. 6, 2020, U.S. Provisional Patent Application No. 63/110,587, filed on Nov. 6, 2020, U.S. Provisional Patent Application No. 63/126,157, filed on Dec. 16, 2020, U.S. Provisional Patent Application No. 63/128,418, filed on Dec. 21, 2020, U.S. Provisional Patent Application No. 63/139,341, filed on Jan. 20, 2021, U.S. Provisional Patent Application No. 63/169,302, filed on Apr. 1, 2021, U.S. Provisional Patent Application No. 63/169,418, filed on Apr. 1, 2021, U.S. Provisional Patent Application No. 63/174,724, filed on Apr. 14, 2021, U.S. Provisional Patent Application No. 63/178,116, filed on Apr. 22, 2021, and U.S. Provisional Patent Application No. 63/191,412, filed on May 21, 2021, are hereby incorporated by reference for all purposes as if presented herein in their entirety.

BACKGROUND OF THE DISCLOSURE

The present disclosure generally relates to trays for holding at least one food product.

SUMMARY OF THE DISCLOSURE

According to one aspect, the disclosure is generally directed to a tray for holding at least one food product, the tray comprising a plurality of panels extending at least partially around an interior of the tray, the plurality of panels comprising a bottom panel, a front panel, a back panel, and at least one side panel, and a plurality of end flaps comprising a plurality of top end flaps cooperating to form a rim extending from the plurality of panels, each top end flap of the plurality of top end flaps foldably connected to an adjacent top end flap of the plurality of top end flaps.

According to another aspect, the disclosure is generally directed to a blank for forming a tray for holding at least one food product, the blank comprising a plurality of panels comprising a bottom panel, a front panel, a back panel, and at least one side panel, and a plurality of end flaps comprising a plurality of top end flaps for cooperating to form a rim extending from the plurality of panels when the tray is formed from the blank, each top end flap of the plurality of top end flaps foldably connected to an adjacent top end flap of the plurality of top end flaps.

According to another aspect, the disclosure is generally directed to a method of forming a tray for holding at least one food product, the method comprising obtaining a blank comprising a plurality of panels, the plurality of panels comprising a bottom panel, a front panel, a back panel, and at least one side panel, the blank further comprising a plurality of end flaps, the plurality of end flaps comprising a plurality of top end flaps, each top end flap of the plurality of top end flaps foldably connected to an adjacent top end flap of the plurality of top end flaps, folding the plurality of panels at least partially around an interior of the tray, and folding the plurality of top end flaps to form a rim extending from the plurality of panels.

Those skilled in the art will appreciate the above-stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

Trays according to the present disclosure can accommodate articles of numerous different shapes. For the purpose of illustration and not for the purpose of limiting the scope of the disclosure, the following detailed description describes articles such as food products, e.g., fruit or vegetable items. In one embodiment, articles described herein can be fruits such as tomatoes (e.g., cherry tomatoes, etc.), berries (e.g., blueberries, raspberries, blackberries, strawberries, etc.), apples, oranges, tangerines, clementines, lemons, limes, cherries, etc. In another embodiment, articles described herein can be product packages, containers, bottles, cans, etc., that are at least partially disposed within the tray embodiments. The articles can be used for packaging food and beverage products, for example. Packaged articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; composite materials; and the like, or any combination thereof.

The articles described herein can include different types of food or beverage products, containers thereof, and/or having different shapes, without departing from the disclosure. In this specification, the terms "lower," "bottom," "upper," and "top" indicate orientations determined in relation to fully erected and upright trays. As described herein, trays can be formed from blanks by overlapping multiple panels, portions, and/or end flaps. Such panels, portions and/or end flaps may be designated herein in terms relative to one another, e.g., "first", "second", "third", etc., in sequential or non-sequential reference, without departing from the disclosure.

Figure 1:
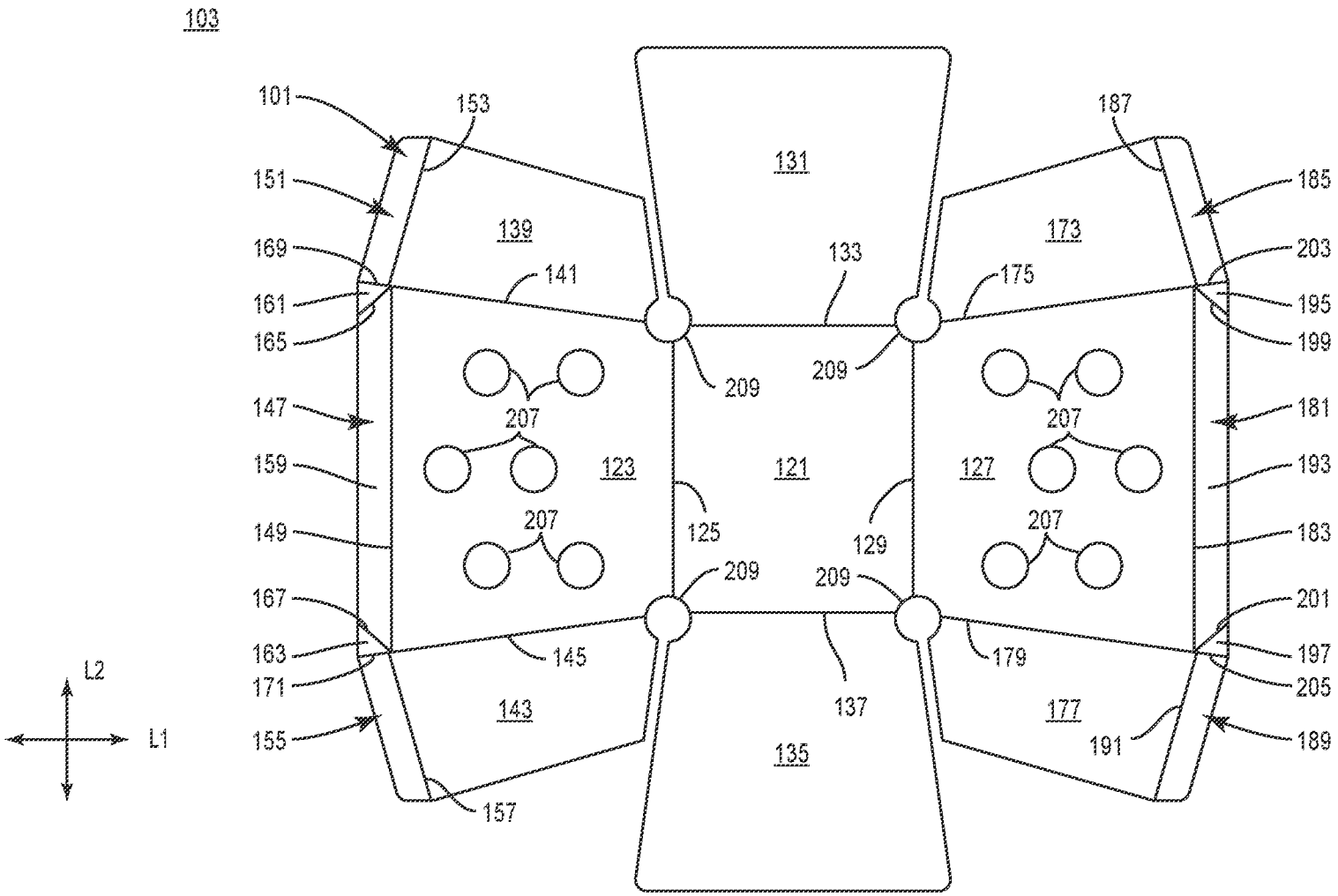
FIG. 1 is a plan view of an exterior surface of a blank used to form a tray according to an exemplary embodiment of the disclosure.

FIG. 1 is a plan view of an exterior surface 101 of a blank, generally indicated at 103, used to form a tray 105 according to a first exemplary embodiment of the disclosure. As described further herein, the blank 103 includes engagement features for forming engagement features of the tray 105 that provide one or more surfaces for engaging a machine element or other component of a system associated with the formation, loading, and/or packaging of the tray 105. In addition, the engagement features of the blank 103/tray 105 provide one or more surfaces for receiving a lidding film, e.g., a polymeric film or other cover overlying the tray 105 to maintain one or more conditions of food products held therein. In embodiments, the trays 105 described herein can have a generally elongate configuration with an open top portion so as to have the general form of a tray.

As shown, the blank 103 has a longitudinal axis L1 and a lateral axis L2 and includes a plurality of panels for extending at least partially around an interior 107 of the tray 105 when the tray 105 is formed from the blank 103. The panels can include a bottom panel 121, a front panel 123 foldably connected to the bottom panel 121 at a lateral fold line 125, a back panel 127 foldably connected to the bottom panel 121 at a lateral fold line 129, a first side panel 131 foldably connected to the bottom panel 121 at a longitudinal fold line 133, and a second side panel 135 foldably connected to the bottom panel 121 at a longitudinal fold line 137.

The blank 103 can also include a plurality of end flaps foldably connected to respective panels of the plurality of panels of the blank 103. In the illustrated embodiment, the end flaps can include a first front side end flap 139 foldably connected to the front panel 123 at an oblique fold line 141, a second front side end flap 143 foldably connected to the front panel 123 at an oblique fold line 145, a front top end flap 147 foldably connected to the front panel 123 at a lateral fold line 149, a first front side top end flap 151 foldably connected to the first front side end flap 139 at an oblique fold line 153, and a second front side top end flap 155 foldably connected to the second front side end flap 143 at an oblique fold line 157.

The top end flap 147 can include a central portion 159 and a pair of corner portions 161, 163 (broadly, "first corner portion", "second corner portion") foldably connected to the central portion 159 at respective oblique fold lines 165, 167 that intersect the fold line 149. The corner portion 161 can be foldably connected to the top end flap 151 at an oblique fold line 169 and the corner portion 163 can be foldably connected to the top end flap 155 at an oblique fold line 171. In the illustrated embodiment, the fold line 169 can be collinear with the fold line 141 and the fold line 171 can be collinear with the fold line 145. In one embodiment, the fold lines 169, 141 can be portions of a single fold line and/or the fold lines 171, 145 can be portions of a single fold line.

The aforementioned arrangement of end flaps is such that the top end flap 151 is foldably connected to the top end flap 147 at/by the corner portion 161, and the top end flap 155 is foldably connected to the top end flap 147 at/by the corner portion 163. In one embodiment, one or both of the corner portions 161, 163 can be considered end flaps distinct from the central portion 159 of the end flap 147. In another embodiment, one or both of the corner portions 161, 163 can be considered a portion of the respective end flaps 151, 155.

Similarly, a first back side end flap 173 can be foldably connected to the back panel 127 at an oblique fold line 175, a second back side end flap 177 can be foldably connected to the back panel 127 at an oblique fold line 179, a back top end flap 181 can be foldably connected to the back panel 127 at a lateral fold line 183, a first back side top end flap 185 can be foldably connected to the first back side end flap 173 at an oblique fold line 187, and a second back side top end flap 189 can be foldably connected to the second back side end flap 177 at an oblique fold line 191.

The back top end flap 181 can include a central portion 193 and a pair of corner portions 195, 197 (broadly, "first corner portion", "second corner portion") foldably connected to the central portion 193 at respective oblique fold lines 199, 201 that intersect the fold line 183. The corner portions 195, 197 can be foldably connected to the respective top end flaps 185, 189 at respective oblique fold lines 203, 205 such that the top end flap 185 is foldably connected to the top end flap 181 at/by the corner portion 195 and such that the top end flap 189 is foldably connected to the top end flap 181 at/by the corner portion 197. The fold line 203 can be collinear with the fold line 175 and the fold line 205 can be collinear with the fold line 179, or, in one embodiment, the fold lines 203, 175 can be portions of a single fold line. In another embodiment, the fold lines 175, 179 can be portions of a single fold line.

The blank 103 can include product visibility features for forming product visibility features of the tray 105. In the illustrated embodiment, each of the front panel 123 and the back panel 127 can include one or more opening 207. In addition, curved cuts 209 can be formed at least partially along corners of the bottom panel 121, and extend into respective portions of the front panel 123, the back panel 127, the side panels 131, 135, and the side end flaps 139, 143, 173, 177. As described further herein, the product visibility features can provide a customer with line-of-sight passages into the interior 107 of the tray 105, for example, to inspect food products held therein.

Figure 2:
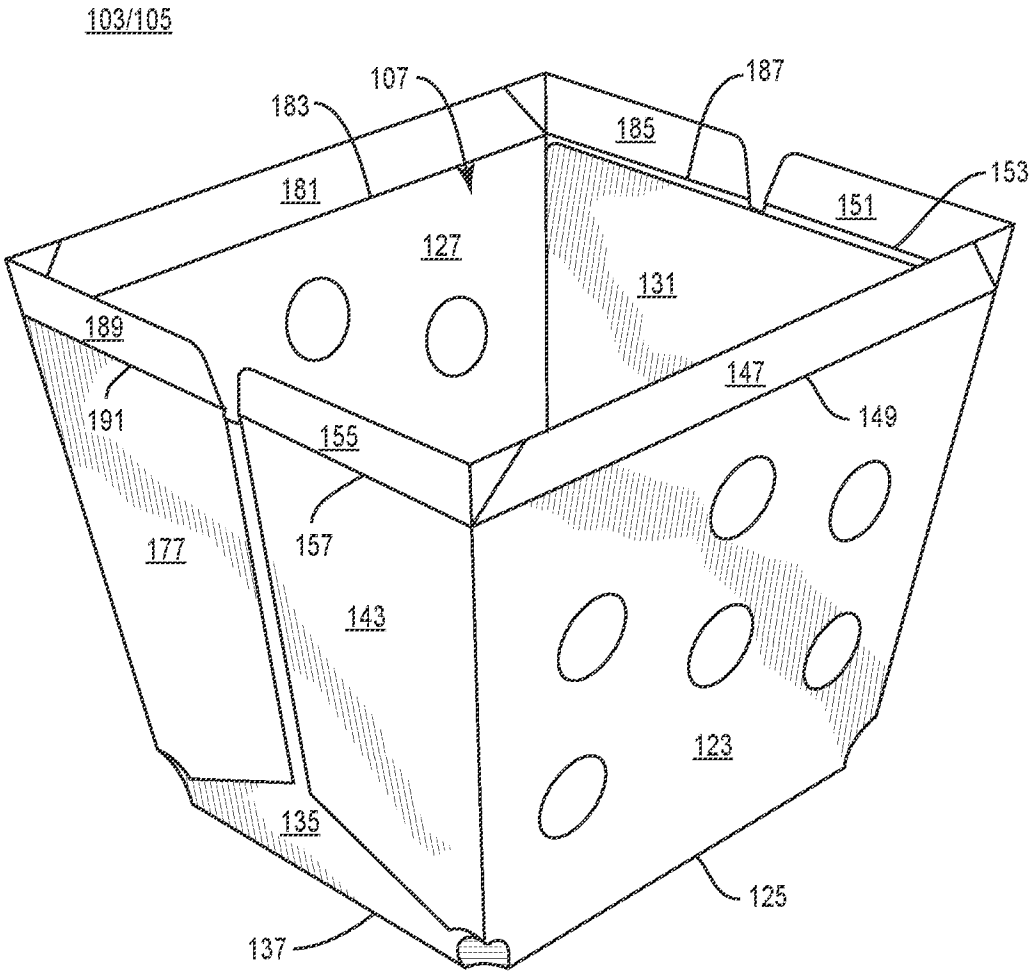
FIG. 2 is a first sequential perspective view of a formation of a tray from the blank of FIG. 1 according to an exemplary embodiment of the disclosure.
Figure 3:
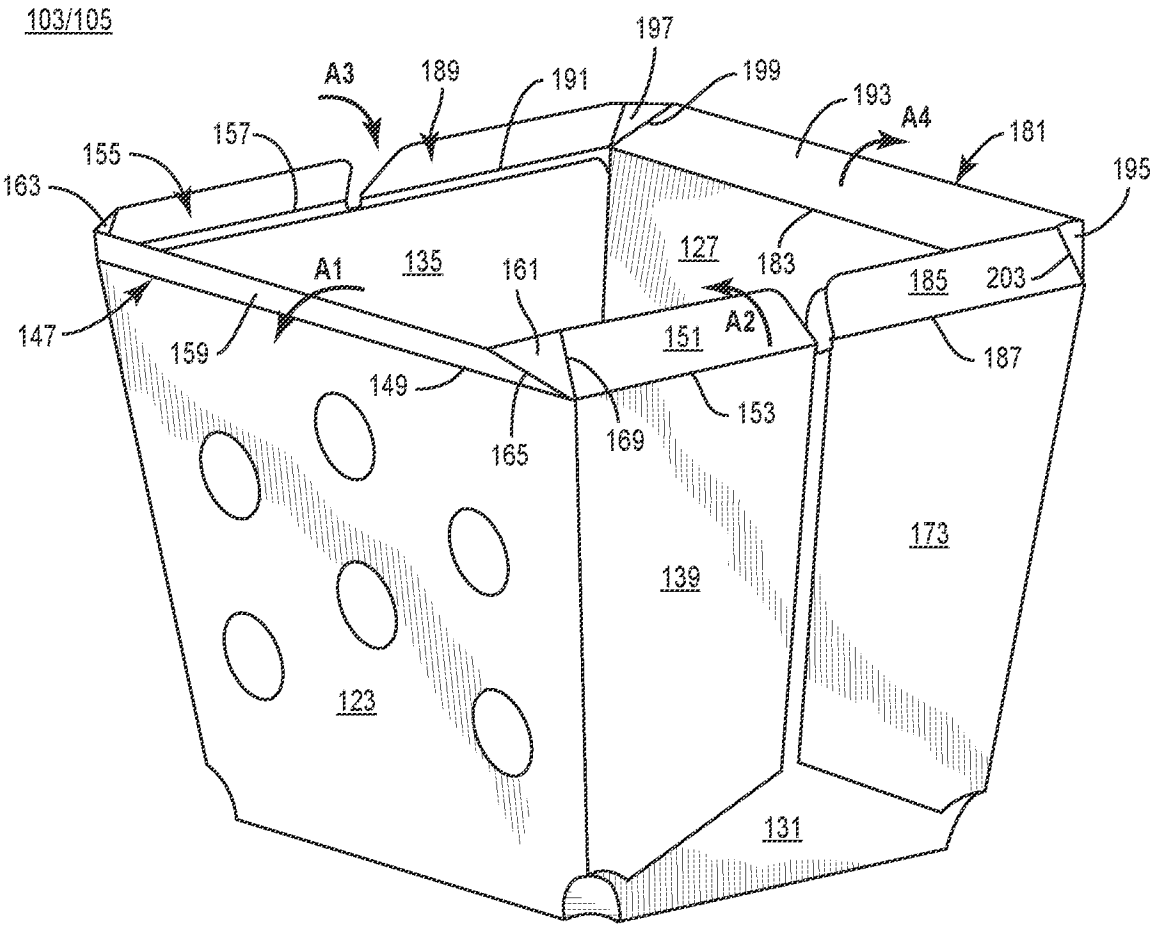
FIG. 3 is a second sequential perspective view of a formation of a tray from the blank of FIG. 1 according to an exemplary embodiment of the disclosure.
Figure 4:
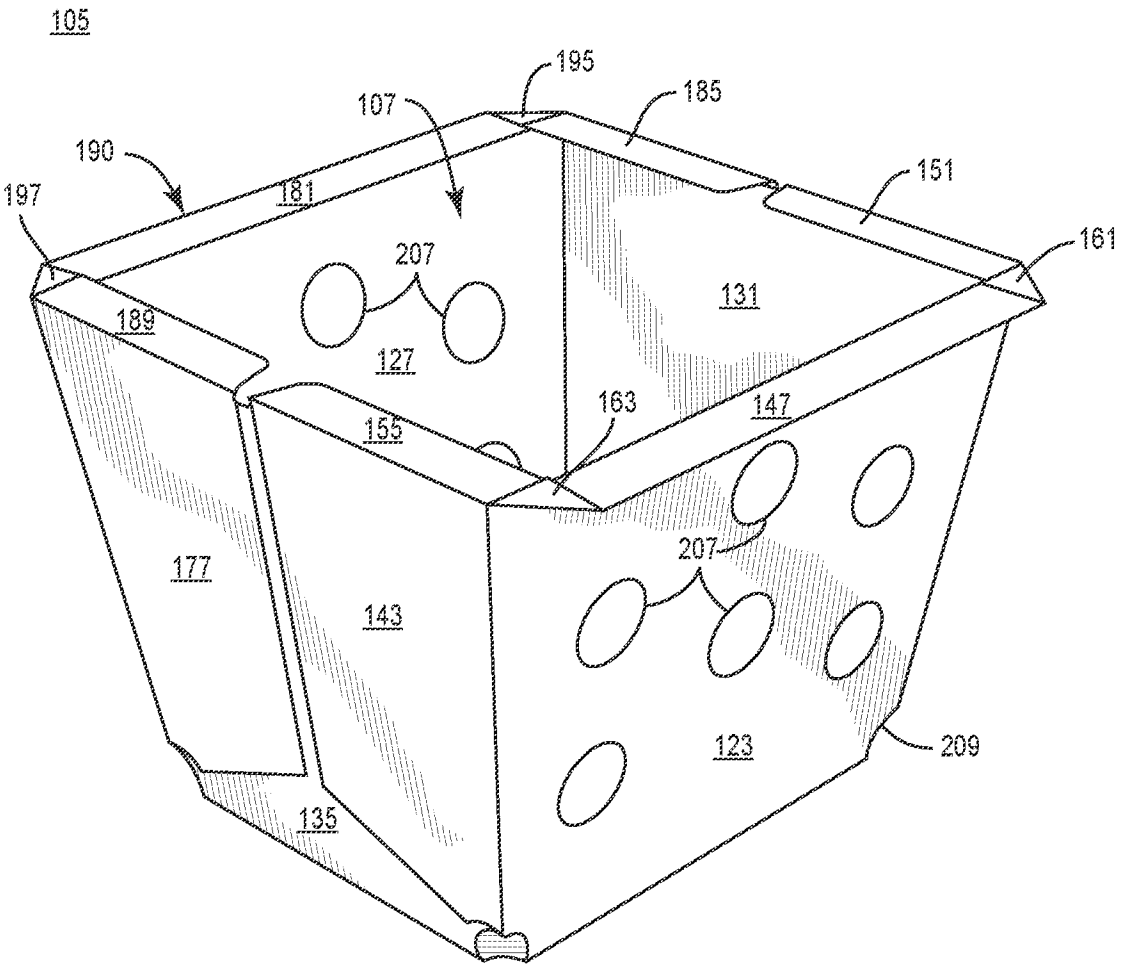
FIG. 4 is a perspective view of a tray formed from the blank of FIG. 1 according to the exemplary embodiment.

Referring to FIGS. 2-4, formation of the tray 105 from the blank 103 is illustrated according to one exemplary embodiment of the disclosure. The blank 103 can be inverted such that the exterior surface 101 is positioned on a supporting surface and such that an interior surface of the blank 103 can be positioned facing upwardly.

The front panel 123, the back panel 127, the first side panel 131, and the second side panel 135 can be folded upwardly relative to the bottom panel 121 at the respective fold lines 125, 129, 133, 137 to at least partially extend around the interior 107 of the tray 105.

Simultaneously or thereafter, the front side end flap 139 can be folded at the fold line 141 into at least partial face-to-face contact with the side panel 131, the front side end flap 143 can be folded at the fold line 145 into at least partial face-to-face contact with the side panel 135, the back side end flap 173 can be folded at the fold line 175 into at least partial face-to-face contact with the side panel 131, and the back side end flap 177 can be folded at the fold line 179 into at least partial face-to-face contact with the side panel 135.

Still referring to FIGS. 2-4, the top end flap 147 can be folded at the fold line 149 in the direction of the arrow A1 outwardly from the interior 107 of the tray 105. During such movement of the central portion 159 of the top panel 147, tension is placed upon the corner portions 161, 163 due to their foldable connection to the top end flaps 151, 155. In this regard, as the central portion 159 of the top end flap 147 folds downwardly, the corner portion 161 folds relative to the central portion 159 at the fold line 165 and the corner portion 163 folds relative to the central portion 159 at the fold line 167.

Further downward movement of the central portion 159 of the top panel 147 causes the corner portion 161 to move into overlapping and at least partial face-to-face contact with the central portion 159, carrying the top end flap 151 to fold at the fold line 153 in the direction of the arrow A2 toward the interior 107 of the tray 105. Similarly, the corner portion 163 is caused by the movement of the central portion 159 of the top panel 147 to move into overlapping and at least partial face-to-face contact with the central portion 159, thereby carrying the top end flap 155 to fold at the fold line 157 in the direction of the arrow A3 toward the interior 107 of the tray 105.

Similarly, the top end flap 181 can be folded at the fold line 183 in the direction of the arrow A4 away from the interior 107 of the tray 105. Such movement of the central portion 193 of the top panel 181 causes tension to be placed upon the corner portions 195, 197 due to their foldable connection to the top end flaps 185, 189. In this regard, as the central portion 193 of the top end flap 181 folds downwardly, the corner portion 195 folds at the fold line 199 into at least partial face-to-face contact with the central portion 193 causing the top end flap 185 to fold at the fold line 187 in the direction of the arrow A2 toward the interior 107 of the tray 105. Such movement of the central portion 193 of the top end flap 181 also causes the corner portion 197 to fold at the fold line 201 into at least partial face-to-face contact with the central portion 193 causing the top end flap 189 to fold at the fold line 191 in the direction of the arrow A3 toward the interior 107 of the tray 105.

In this regard, the arrangement of the corner portions 161, 163 of the top end flap 147 and the corner portions 195, 197 of the top end flap 181 is such that engagement and folding of one or both of the top end flaps 147, 181 causes folding of at least one other top end flap, e.g., respective top end flaps 151, 155 and/or top end flaps 185, 189. Accordingly, engagement and folding of the top end flaps 147, 181 by a machine component or other engaging structure can effect folding of the top end flaps 151, 155, 185, 189 such that a forming apparatus associated with the blank 103/tray 105 can be configured without needing to directly engage and fold the top end flaps 151, 155, 185, 189. Such a configuration can, for example, provide significant manufacturing streamlining, cost savings, efficiency increases, etc.

In the illustrated embodiment of the tray 105, the panels 123, 127, 131, 135 can extend generally upwardly and obliquely outwardly from the bottom panel 121 such that the tray 105 has a generally tapered configuration, e.g., such that a top opening defined by the upper edges of the panels 123, 127, 131, 135 is larger than the bottom panel 121. Furthermore, the top end flaps 147, 181, 151, 155, 185, 189 cooperate to form a rim 190 that extends from the plurality of panels 123, 127, 131, 135. The top end flaps 147, 181, 151, 155, 185, 189 can be arranged in generally coplanar relation and parallel to a plane defined by the bottom panel 121, and with the top end flaps 147, 181 extending away from the interior 107 of the tray 105 and with the top end flaps 151, 155, 185, 189 extending toward the interior 107 of the tray 105.

Figure 5:
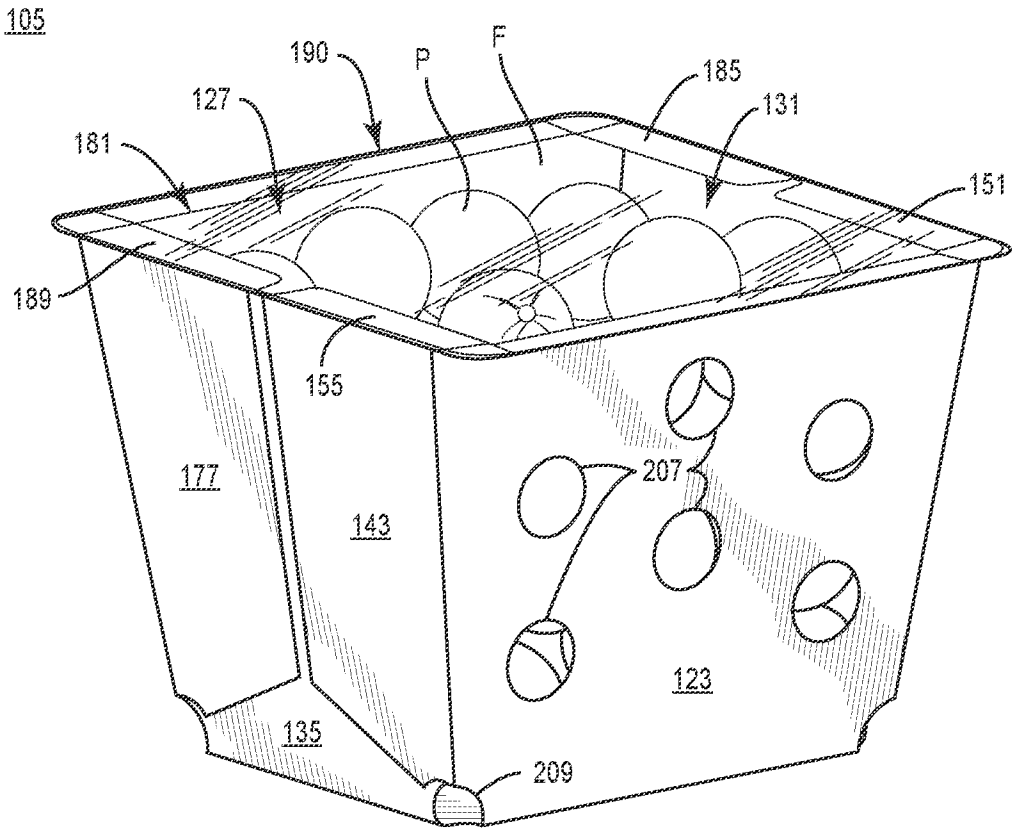
FIG. 5 is a perspective view of the tray of FIG. 4 holding food products and provided with a lidding film.

With additional reference to FIG. 5, as shown, one or more food products P can be dropped, placed, or otherwise positioned in the interior 107 of the tray 105 during or subsequent to the aforementioned steps. In the illustrated embodiment, the food products P can be tomatoes, such as cherry tomatoes, though one or more of the food products P can be a different food product without departing from the disclosure.

The product visibility features of the tray 105 can provide a customer with the ability to at least partially see the food products P through the sides of the tray 105, for example, through one or more of the openings 207 or gaps between panels/flaps provided by one or more of the cuts 209. It will be understood that one or more of the openings 207/gaps defined by the cuts 209 can provide ventilation to the food products P and/or drainage, for example, for runoff, condensation or other moisture, etc.

Engagement features of the tray 105 include the arrangement of the top end flaps 147, 181, 151, 155, 185, 189, and portions thereof, e.g., the rim 190. As shown, the folded arrangement of the top end flaps 147, 181 extends outwardly from the respective front panel 123 and back panel 127 to provide one or more engagement surfaces for being engaged/supported by an element associated with a forming apparatus for the tray 105, for example a machine element such as a grasper, fork, pincer, rail, etc. In one embodiment, the exterior (e.g., downward facing) surface of the top end flaps 147, 181 can present engagement surfaces for being engaged/supported by such a machine element. In other embodiments, engagement surfaces can include any combination of one or more of the exterior, interior (e.g., upward facing), and/or side-facing surfaces of one or both of the top end flaps 147, 181.

With continued reference to FIG. 5, the positioning of the top end flaps 151, 155, 185, 189 extending inwardly toward the interior 107 of the tray 105, together with the top end flaps 147, 181, present a plurality of engagement/support surfaces for engaging/supporting a lidding film F, e.g., a plastic or other polymeric film, or other covering structure. The lidding film F can thus be positioned extending across a top opening of the tray 105 in contact with one or more surfaces of one or more of the top end flaps 147, 181, 151, 155, 185, 189 to cover the interior 107 of the tray 105 and maintain one or more conditions of the food products P held therein, e.g., freshness, ripeness, moisture content, etc. It will be understood that the lidding film F can minimize, inhibit, and/or prevent the passage of one or more materials into the interior 107 of the tray 105, for example, condensation or other moisture, insects or other pests, dirt, debris, etc. In one embodiment, the tray 105 can be provided together with the lidding film F and one or more food products P as a package.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blanks. In accordance with the above-described embodiments, the blank may be constructed of paperboard of a caliper such that it is heavier and more rigid than ordinary paper. The blanks can also be constructed of other materials, such as cardboard, hard paper, or any other material having properties suitable for enabling the trays, to function at least generally as described above. The blanks can also be laminated to or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the spaced apart slits to be replaced with a continuous slit, a continuous score, or the like. For example, a cut line can be a continuous slit or could be wider than a slit without departing from the present disclosure. Also, a tear line can be a series of cut scores passing completely, or partially, through the material, that are separated by nicks.

The term "glue" is intended to encompass all manner of adhesives commonly used to secure tray panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A tray for holding at least one food product, the tray comprising:

a plurality of panels extending at least partially around an interior of the tray, the plurality of panels comprising a bottom panel, a front panel, a back panel, and at least one side panel; and a plurality of end flaps comprising a plurality of top end flaps cooperating to form a rim extending from the plurality of panels, each top end flap of the plurality of top end flaps foldably connected to an adjacent top end flap of the plurality of top end flaps, the plurality of top end flaps comprising a front top end flap and at least one front side top end flap, one of the front top end flap and the at least one front side top end flap extending away from the interior of the tray, and the other of the front top end flap and the at least one front side top end flap extending toward the interior of the tray and such that the front top end flap and the at least one front side top end flap are arranged in generally coplanar relation.

2. The tray of claim 1, wherein the front top end flap is foldably connected to each of the front panel and the at least one front side top end flap.

3. The tray of claim 2, wherein the front top end flap extends away from the interior of the tray and the at least one front side top end flap extends toward the interior of the tray.

4. The tray of claim 2, wherein the plurality of top end flaps further comprises a back top end flap and at least one back side top end flap, the back top end flap foldably connected to each of the at least one back side top end flap and the back panel.

5. The tray of claim 4, wherein the plurality of end flaps further comprises at least one front side end flap foldably connected to the front panel and at least one back side end flap foldably connected to the back panel, the at least one front side top end flap foldably connected to the at least one front side end flap, the at least one back side top end flap foldably connected to the at least one back side end flap.

6. The tray of claim 5, wherein each of the at least one front side end flap and the at least one back side end flap is in face-to-face contact with the at least one side panel.

7. The tray of claim 5, wherein the at least one side panel is a first side panel, the at least one front side end flap is a first front side end flap, the at least one front side top end flap is a first front side top end flap, the at least one back side end flap is a first back side end flap, the at least one back side top end flap is a first back side top end flap, the plurality of panels further comprises a second side panel, the plurality of end flaps further comprises a second front side end flap foldably connected to the front panel, a second back side end flap foldably connected to the back panel, a second front side top end flap foldably connected to each of the second front side end flap and the front top end flap, and a second back side top end flap foldably connected to each of the second back side end flap and the back top end flap.

8. The tray of claim 1, wherein the front top end flap comprises a central portion and at least one corner portion foldably connected to the central portion at an oblique fold line, the at least one corner portion is in face-to-face contact with the central portion.

9. The tray of claim 8, wherein the at least one corner portion is foldably connected to the at least one side top end flap at an oblique fold line.

10. The tray of claim 9, wherein the at least one corner portion is a first corner portion, and the top end flap further comprises a second corner portion foldably connected to the central portion at an oblique fold line.

11. The tray of claim 1, wherein the tray further comprises product visibility features comprising a plurality of openings in at least one panel of the plurality of panels.

12. A blank for forming a tray for holding at least one food product, the blank comprising:

a plurality of panels comprising a bottom panel, a front panel, a back panel, and at least one side panel; and a plurality of end flaps comprising a plurality of top end flaps for cooperating to form a rim extending from the plurality of panels when the tray is formed from the blank, each top end flap of the plurality of top end flaps foldably connected to an adjacent top end flap of the plurality of top end flaps, the plurality of top end flaps comprising a front top end flap and at least one front side top end flap, one of the front top end flap and the at least one front side top end flap for extending away from the interior of the tray formed from the blank, the other of the front top end flap and the at least one front side top end flap for extending toward the interior of the tray formed from the blank such that the front top end flap and the at least one front side top end flap are for being positioned in generally coplanar relation when the tray is formed from the blank.

13. The blank of claim 12, wherein the front top end flap is foldably connected to each of the front panel and the at least one front side top end flap.

14. The blank of claim 13, wherein the plurality of top end flaps further comprises a back top end flap and at least one back side top end flap, the back top end flap foldably connected to each of the at least one back side top end flap and the back panel.

15. The blank of claim 14, wherein the plurality of end flaps further comprises at least one front side end flap foldably connected to the front panel and at least one back side end flap foldably connected to the back panel, the at least one front side top end flap foldably connected to the at least one front side end flap, the at least one back side top end flap foldably connected to the at least one back side end flap.

16. The blank of claim 15, wherein the at least one side panel is a first side panel, the at least one front side end flap is a first front side end flap, the at least one front side top end flap is a first front side top end flap, the at least one back side end flap is a first back side end flap, the at least one back side top end flap is a first back side top end flap, the plurality of panels further comprises a second side panel, the plurality of end flaps further comprises a second front side end flap foldably connected to the front panel, a second back side end flap foldably connected to the back panel, a second front side top end flap foldably connected to each of the second front side end flap and the front top end flap, and a second back side top end flap foldably connected to each of the second back side end flap and the back top end flap.

17. The blank of claim 12, wherein the front top end flap comprises a central portion and at least one corner portion foldably connected to the central portion at an oblique fold line, the at least one corner portion is for being positioned in face-to-face contact with the central portion when the tray is formed from the blank.

18. The blank of claim 17, wherein the at least one corner portion is foldably connected to the at least one side top end flap at an oblique fold line.

19. The blank of claim 18, wherein the at least one corner portion is a first corner portion, and the top end flap further comprises a second corner portion foldably connected to the central portion at an oblique fold line.

20. The blank of claim 12, wherein the blank further comprises product visibility features comprising a plurality of openings in at least one panel of the plurality of panels.

21. A method of forming a tray for holding at least one food product, the method comprising:

obtaining a blank comprising a plurality of panels, the plurality of panels comprising a bottom panel, a front panel, a back panel, and at least one side panel, the blank further comprising a plurality of end flaps, the plurality of end flaps comprising a plurality of top end flaps, each top end flap of the plurality of top end flaps foldably connected to an adjacent top end flap of the plurality of top end flaps, the plurality of top end flaps comprising a front top end flap and at least one front side top end flap;

folding the plurality of panels at least partially around an interior of the tray; and folding the plurality of top end flaps to form a rim extending from the plurality of panels and such that one of the front top end flap and the at least one front side top end flap extends away from the interior of the tray and the other of the front top end flap and the at least one front side top end flap extends toward the interior of the tray and such that the front top end flap and the at least one front side top end flap are positioned in generally coplanar relation.

22. The method of claim 21, wherein the front top end flap is foldably connected to each of the front panel and the at least one front side top end flap.

23. The method of claim 22, wherein the folding the plurality of top end flaps comprises positioning the front top end flap extending away from the interior of the tray and positioning the at least one front side top end flap extending toward the interior of the tray.

24. The method of claim 22, wherein the plurality of top end flaps further comprises a back top end flap and at least one back side top end flap, the back top end flap foldably connected to each of the at least one back side top end flap and the back panel.

25. The method of claim 24, wherein the plurality of end flaps further comprises at least one front side end flap foldably connected to the front panel and at least one back side end flap foldably connected to the back panel, the at least one front side top end flap foldably connected to the at least one front side end flap, the at least one back side top end flap foldably connected to the at least one back side end flap.

26. The method of claim 25, wherein the method further comprises folding each of the at least one front side end flap and the at least one back side end flap to be in face-to-face contact with the at least one side panel.

27. The method of claim 25, wherein the at least one side panel is a first side panel, the at least one front side end flap is a first front side end flap, the at least one front side top end flap is a first front side top end flap, the at least one back side end flap is a first back side end flap, the at least one back side top end flap is a first back side top end flap, the plurality of panels further comprises a second side panel, the plurality of end flaps further comprises a second front side end flap foldably connected to the front panel, a second back side end flap foldably connected to the back panel, a second front side top end flap foldably connected to each of the second front side end flap and the front top end flap, and a second back side top end flap foldably connected to each of the second back side end flap and the back top end flap.

28. The method of claim 21, wherein the front top end flap comprises a central portion and at least one corner portion foldably connected to the central portion at an oblique fold line, the folding the plurality of top end flaps comprises positioning the at least one corner portion is in face-to-face contact with the central portion.

29. The method of claim 28, wherein the at least one corner portion is foldably connected to the at least one side top end flap at an oblique fold line.

30. The method of claim 29, wherein the at least one corner portion is a first corner portion, and the top end flap further comprises a second corner portion foldably connected to the central portion at an oblique fold line.

31. The method of claim 21, wherein the blank further comprises product visibility features comprising a plurality of openings in at least one panel of the plurality of panels.

* * * * *